US006542437B1

(12) United States Patent
Chen

(10) Patent No.: US 6,542,437 B1
(45) Date of Patent: Apr. 1, 2003

(54) LASER POINTER WITH BUILT-IN ACCESSORIES

(76) Inventor: Rui Chen, 726 60th St., #3, New York, NY (US) 11220

( * ) Notice: Subject to any disclaimer, the term of this patent is extended or adjusted under 35 U.S.C. 154(b) by 0 days.

(21) Appl. No.: 09/637,673

(22) Filed: Aug. 14, 2000

(51) Int. Cl.[7] ..... G04B 37/12; B43K 29/10
(52) U.S. Cl. ..... 368/10; 368/278; 401/195
(58) Field of Search ..... 368/10, 69, 82, 368/278; 362/118; 401/109, 52, 195

(56) References Cited

U.S. PATENT DOCUMENTS 4,215,531 A * 8/1980 Wong ..... 368/10
4,382,687 A * 5/1983 Lemelson ..... 368/278
4,585,364 A * 4/1986 Liaw ..... 368/278
5,193,897 A * 3/1993 Halsey ..... 362/118
5,307,253 A * 4/1994 Jehn ..... 362/118
5,617,304 A * 4/1997 Huang ..... 362/118
6,273,582 B1 * 8/2001 Taggart et al.
6,290,134 B1 * 9/2001 Rando et al.

FOREIGN PATENT DOCUMENTS

JP 61025089 * 3/1986 ..... 368/98

* cited by examiner

*Primary Examiner*—Vit Miska
*Assistant Examiner*—Jeanne-Marguerite Goodwin
(74) *Attorney, Agent, or Firm*—Goldstein & Lavas, P.C.

(57) ABSTRACT

A laser pointer with built-in accessories including an elongated housing having a first end, a second end, and a body disposed therebetween. A laser is disposed within the first end of the elongated housing. The laser has a window disposed within the first end for directing a beam outwardly therethrough. A pen is disposed within the second end of the elongated housing.

4 Claims, 1 Drawing Sheet

LASER POINTER WITH BUILT-IN ACCESSORIES

BACKGROUND OF THE INVENTION

The present invention relates to a laser pointer with built-in accessories and more particularly pertains to allowing a laser pointer to perform other important functions.

The use of laser pointer devices is known in the prior art. More specifically, laser pointer devices heretofore devised and utilized for the purpose of allowing items to be pointed out are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,690,418 to Hsiung discloses a laser pointer for use in pointing and for vertical and horizontal alignment in construction work. U.S. Pat. No. 5,838,639 to Hwang discloses a wrist watch with a laser pointer incorporated. U.S. Pat. No. 5,993,026 to Wu discloses a laser pointer enclosed in a metal barrel casing.

While these devices fulfill their respective, particular objective and requirements, the aforementioned patents do not describe a laser pointer with built-in accessories for allowing a laser pointer to perform other important functions.

In this respect, the laser pointer with built-in accessories according to the present invention substantially departs from the conventional concepts and designs of the prior art, and in doing so provides an apparatus primarily developed for the purpose of allowing a laser pointer to perform other important functions.

Therefore, it can be appreciated that there exists a continuing need for a new and improved laser pointer with built-in accessories which can be used for allowing a laser pointer to perform other important functions. In this regard, the present invention substantially fulfills this need.

SUMMARY OF THE INVENTION

In the view of the foregoing disadvantages inherent in the known types of laser pointer devices now present in the prior art, the present invention provides an improved laser pointer with built-in accessories. As such, the general purpose of the present invention, which will be described subsequently in greater detail, is to provide a new and improved laser pointer with built-in accessories which has all the advantages of the prior art and none of the disadvantages.

To attain this, the present invention essentially comprises an elongated cylindrical housing having a first end, a second end, and a body disposed therebetween. A laser is disposed within the first end of the elongated cylindrical housing. The laser has a window disposed within the first end for directing a beam outwardly therethrough. The laser includes a control switch disposed within the body of the elongated cylindrical housing. A pen is disposed within the second end of the elongated cylindrical housing. A clock is disposed within the body of the elongated cylindrical housing. The clock includes an LCD and an alarm. The clock includes a control switch used for setting a time of day, an alarm time, and to activate and deactivate the alarm.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved laser pointer with built-in accessories which has all the advantages of the prior art laser pointer devices and none of the disadvantages.

It is another object of the present invention to provide a new and improved laser pointer with built-in accessories which may be easily and efficiently manufactured and marketed.

It is a further object of the present invention to provide a new and improved laser pointer with built-in accessories which is of durable and reliable construction.

An even further object of the present invention is to provide a new and improved laser pointer with built-in accessories which is susceptible of a low cost of manufacture with regard to both materials and labor, and which accordingly is then susceptible of low prices of sale to the consuming public, thereby making such a laser pointer with built-in accessories economically available to the buying public.

Even still another object of the present invention is to provide a new and improved laser pointer with built-in accessories for allowing a laser pointer to perform other important functions.

Lastly, it is an object of the present invention to provide a new and improved laser pointer with built-in accessories including an elongated housing having a first end, a second end, and a body disposed therebetween. A laser is disposed-within the first end of the elongated housing. The laser has a window disposed within the first end for directing a beam outwardly therethrough. A pen is disposed within the second end of the elongated housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
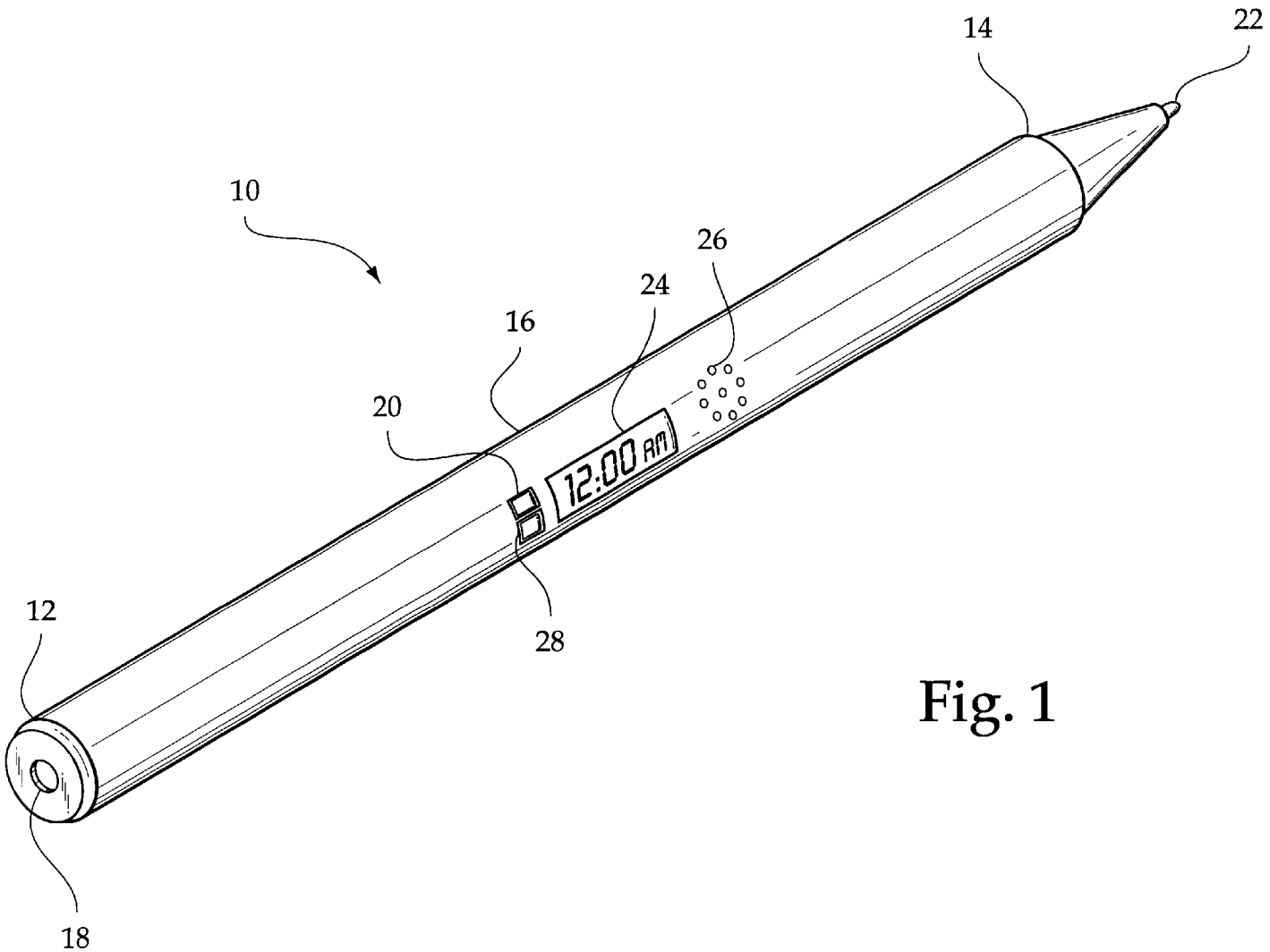
FIG. 1 is a perspective view of the preferred embodiment of the laser pointer with built-in accessories constructed in accordance with the principles of the present invention.

With reference now to the drawings, and in particular, to FIG. 1 thereof, the preferred embodiment of the new and improved laser pointer with built-in accessories embodying the principles and concepts of the present invention and generally designated by the reference number 10 will be described.

Specifically, it will be noted in the figure that the device relates to a laser pointer with built-in accessories for allowing a laser pointer to perform other important functions. In its broadest context, the device consists of an elongated cylindrical housing, a laser, a pen, and a clock Such components are individually configured and correlated with respect to each other so as to attain the desired objective.

The elongated cylindrical housing has a first end 12, a second end 14, and a body 16 disposed therebetween. The housing could also be provided with a clip or the like to allow the present invention to be easily attached to the user's shirt or other garment.

The laser is disposed within the first end 12 of the elongated cylindrical housing. The laser has a window 18 disposed within the first end 12 for directing a beam outwardly therethrough. The laser includes a control switch 20 disposed within the body 16 of the elongated cylindrical housing. The control switch 20 allows for the laser to be activated whereby the beam will be directed out through the window 18.

The pen 22 is disposed within the second end 14 of the elongated cylindrical housing. The pen 22 could be provided with a removable cap, or could utilize a twisting head to allow a tip of the pen 22 to be extended or retracted.

The clock is disposed within the body 16 of the elongated cylindrical housing. The clock includes an LCD 24 and an alarm 26. The LCD 24 will show the time of day. The clock includes a control switch 28 used for setting a time of day, an alarm time, and to activate and deactivate the alarm 26.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A laser pointer with built-in accessories for allowing a laser pointer to perform other important functions comprising, in combination:

an elongated cylindrical housing having a first end, a second end, and a body disposed therebetween;

a laser disposed within the first end of the elongated cylindrical housing, the laser having a window disposed within the first end for directing a beam outwardly therethrough, the laser including a control switch disposed within the body of the elongated cylindrical housing;

a pen disposed within the second end of the elongated cylindrical housing; and a clock disposed within the body of the elongated cylindrical housing, the clock including an LCD and an alarm, the clock including a control switch used for setting a time of day, an alarm time, and to activate and deactivate the alarm.

2. A laser pointer with built-in accessories for allowing a laser pointer to perform other important functions comprising, in combination:

an elongated housing having a first end, a second end, and a body disposed therebetween;

a laser disposed within the first end of the elongated housing, the laser having a window disposed within the first end for directing a beam outwardly therethrough;

a pen disposed within the second end of the elongated housing; and a clock disposed within the body of the elongated housing.

3. A laser pointer with built-in accessories as set forth in claim 2, wherein the laser includes a control switch disposed within the body of the elongated housing.

4. A laser pointer with built-in accessories as set forth in claim 2, wherein the clock includes an LCD and an alarm, the clock including a control switch used for setting a time of day, an alarm time, and to activate and deactivate the alarm.

* * * * *